US006270372B1

(12) United States Patent
Jenner et al.

(10) Patent No.: US 6,270,372 B1
(45) Date of Patent: Aug. 7, 2001

(54) PATCH CORD CONNECTOR

(75) Inventors: Royal Jenner, Tinley Park; Chad A. Follmar, Chicago, both of IL (US)

(73) Assignee: Panduit Corp., Tinley Park, IL (US)

( * ) Notice: Subject to any disclaimer, the term of this patent is extended or adjusted under 35 U.S.C. 154(b) by 576 days.

(21) Appl. No.: 08/721,395

(22) Filed: Sep. 26, 1996

(51) Int. Cl.[7] ..... H01R 4/24
(52) U.S. Cl. ..... 439/405; 439/941
(58) Field of Search ..... 439/404, 405, 439/922, 941

(56) References Cited

U.S. PATENT DOCUMENTS

| | | | | |
|---|---|---|---|---|
| 3,699,498 | | 10/1972 | Hardesty et al. . | |
| 3,798,587 | | 3/1974 | Ellis, Jr. et al. . | |
| 3,985,416 | | 10/1976 | Dola et al. . | |
| 4,153,325 | * | 5/1979 | Asick | 439/405 |
| 4,241,970 | | 12/1980 | Rider, Jr. et al. . | |
| 4,252,397 | * | 2/1981 | Eigenbrode et al. | 439/405 |
| 4,650,269 | | 3/1987 | Denkmann et al. . | |
| 4,902,242 | * | 2/1990 | Davis et al. | 439/404 |
| 4,975,078 | | 12/1990 | Stroede et al. . | |
| 5,226,835 | | 7/1993 | Baker, III et al. . | |
| 5,399,107 | | 3/1995 | Gentry et al. . | |

* cited by examiner

*Primary Examiner*—Gary Paumen
(74) *Attorney, Agent, or Firm*—Robert A. McCann

(57) ABSTRACT

A patch cord connector for use in 110 style cross-connect systems includes a two piece housing with snaps located on the conductor housing, an angled wire housing front to simplify terminations and a double staggering arrangement of the conductors to achieve category 5 performance.

15 Claims, 6 Drawing Sheets

PATCH CORD CONNECTOR

TECHNICAL FIELD

The present invention relates to an electrical connector and more particularly to a patch cord connector for a cross-connect system that achieves category 5 required performance and is more readily terminateable.

BACKGROUND OF THE INVENTION

Cross-connect wiring systems are well-known and include panels or wiring blocks which terminate cables and have an end adapted to interconnect with patch cord connectors. These cross-connect systems are generally utilized for connecting between wiring blocks of incoming and outgoing wiring systems, such as can be found in wiring closets. The 110 system patch cord connector generally terminates a cable holding a plurality of wires and connects to a 110-style connector on a wiring block or panel. With the recent increase in the number of users on networks, as well as the higher data rates being utilized, it has become a necessity to design electrical connectors for use with the cross-connect system which will reduce the effect of the crosstalk to achieve category 5 performance. One example can be seen in the prior art patch cord connector of U.S. Pat. No. 5,226,835 to Baker, III et al. and assigned to AT&T Bell Laboratories. AT&T's patent utilizes a crossing over of adjacent contacts to help reduce crosstalk between adjacent pairs. The bending required.to achieve the proper crossover results in a more difficult manufacturing process of the conductors and a more complicated assembly operation. Additionally, the particular placement and extent of the bending of the conductors results in a higher susceptibility to buckling during connecting and disconnecting of the patch cord connector.

Therefore, improvement in the art of designing patch cord connectors for cross-connect systems is still desired.

SUMMARY OF THE INVENTION

It is therefore, an object of the present invention to provide an improved cross-connect system patch cord connector.

It is further an object of the present invention to provide an improved patch cord connector achieving category 5 performance.

It is still further an object of the present invention to provide a patch cord connector which is more readily both factory and field terminateable.

In general an electric connector of the present invention includes a dielectric housing and a plurality of conductors situated within the housing having a generally flat blade portion disposed at an output end of the housing, an intermediate portion and an insulation displacement contact (IDC) portion for receiving an individual wire, wherein the intermediate portions of adjacent conductors are alternately situated substantially in a lower or an upper plane and are alternately of a shorter or a longer length.

DESCRIPTION OF THE PREFERRED EMBODIMENT

Figure 1:
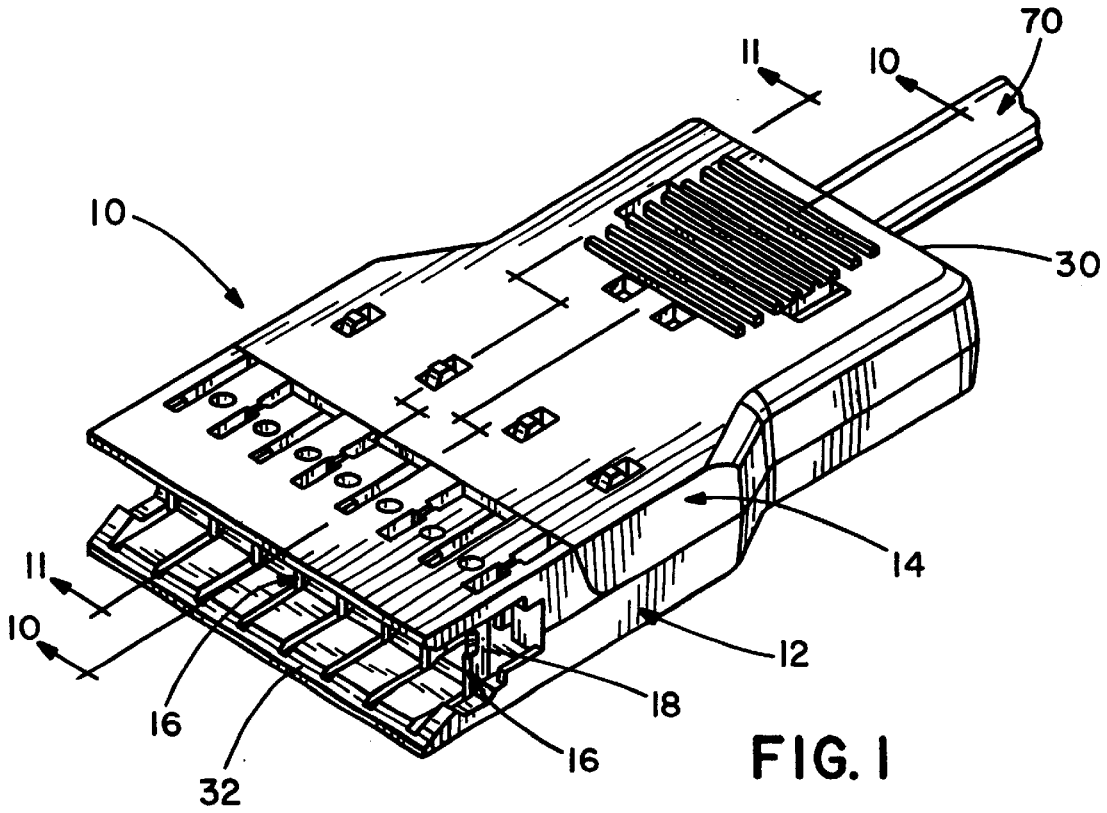
FIG. 1 is a perspective view of the patch cord connector of the present invention.
Figure 2:
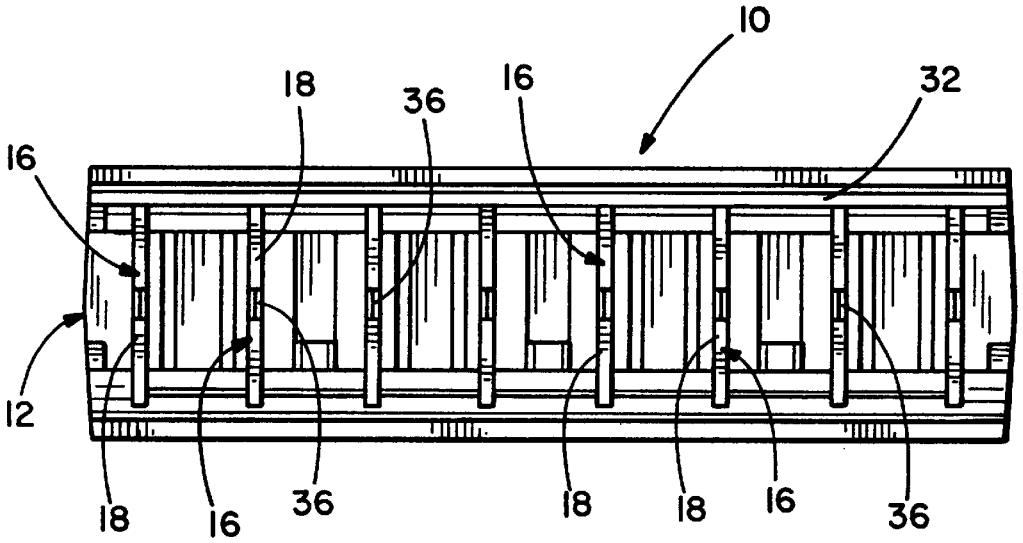
FIG. 2 is a front end view of the patch cord connector of FIG. 1.
Figure 3:
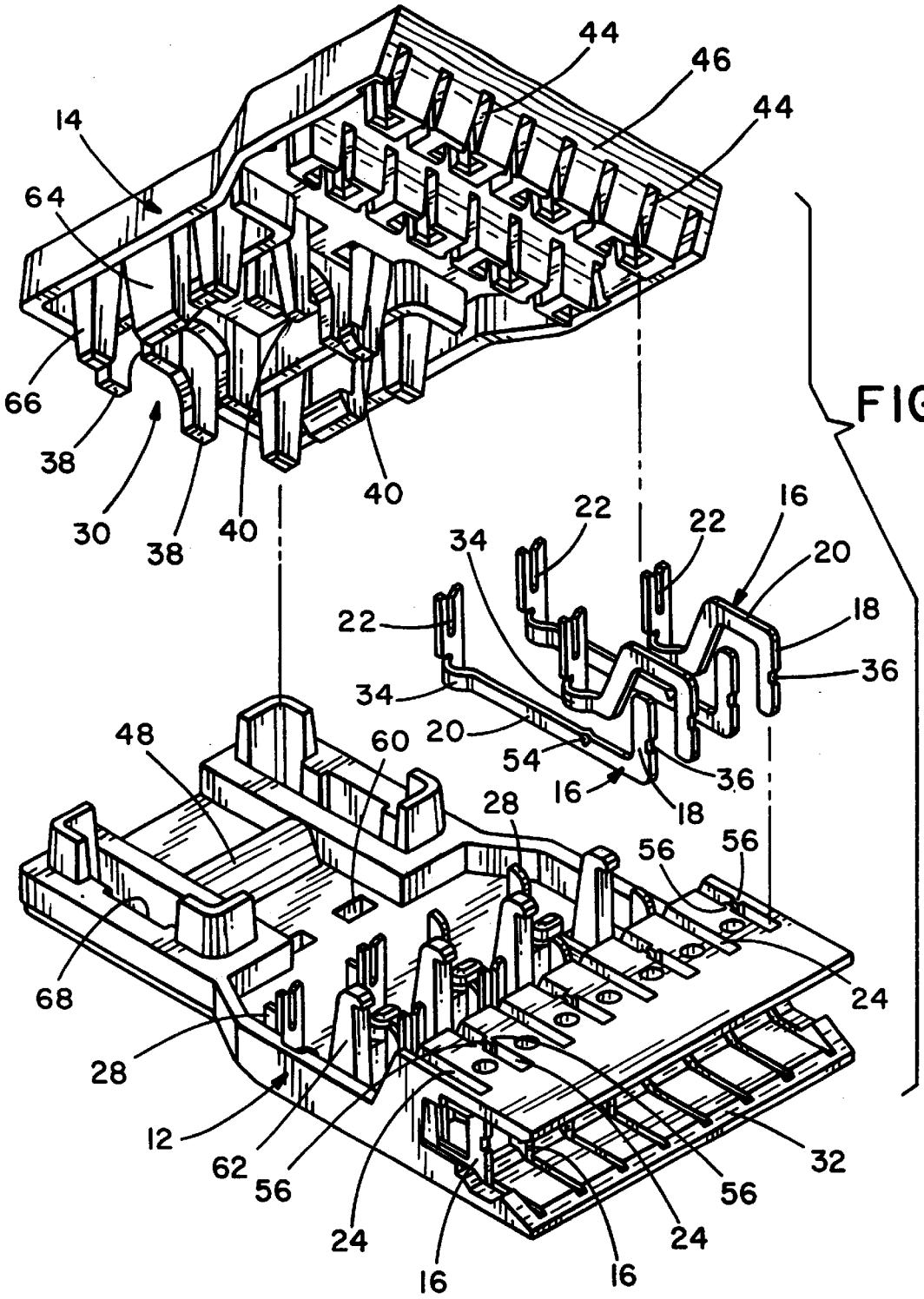
FIG. 3 is an exploded perspective view of the patch cord connector of FIG. 1.

A patch cord connector embodying the concept of the present invention is designated generally by the reference numeral 10 in the accompanying drawings. As shown in FIGS. 1 and 3, patch cord connector 10 is comprised of a pair of matable housing sections including a bottom conductor housing section 12 and a top wire housing section 14 formed for example, by a flame retardant polycarbonate resin. The patch cord connector 10 terminates a cable 70 at an input end 30 of the housing and includes conductors 16 with end portions positioned at an output end 32 of the housing that interconnect with insulation displacement contacts on a wiring block patch panel (not shown).

As best seen in FIG. 3, conductor housing section 12 includes a plurality of conductors 16 including a generally flat blade portion 18 disposed at the output end 32 of the housing, an intermediate portion 20 and an insulation displacement contact portion 22 for receiving a plurality of individual wires of cable 70. The conductors 16 are factory inserted and firmly embedded in their respective conductor slots 24. The conductor IDC 22 is supported against the forces from mating with a connecting block IDC (not shown) by front 26 and rear supports 28 formed on the conductor housing section. The intermediate portion 20 includes a small jog 34 near the IDC end 22 which is necessary in order to fit all of the conductors 16 within the spacial restraints of the conductor housing 14. The conductor's blade portion 18 includes a coined area 36 formed into a 45° bevel which allows for easier insertion of the patch cord conductors 16 into the connector block IDC's (not shown).

Figure 4:
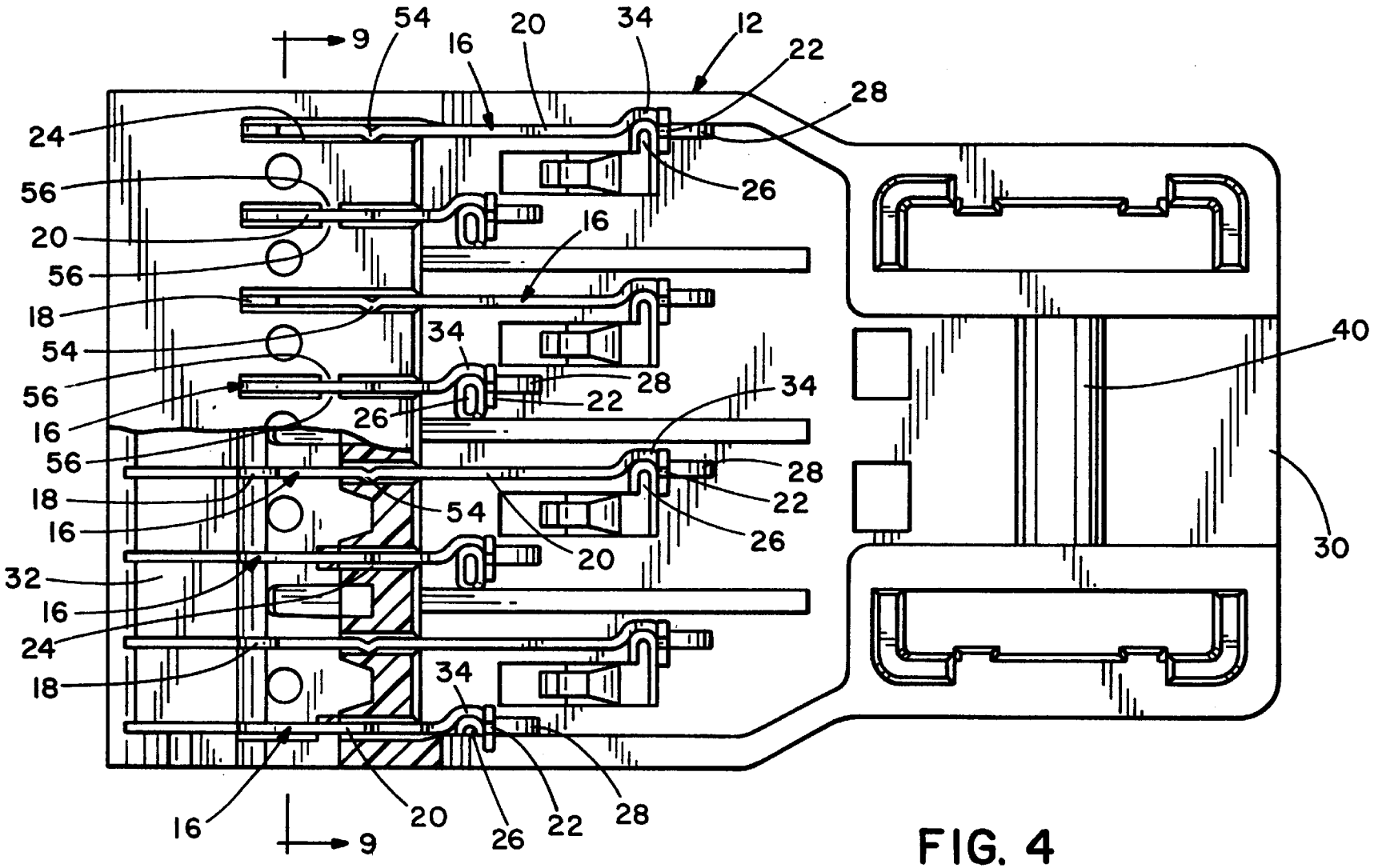
FIG. 4 is a plan view of the conductor housing of the patch cord connector of FIG. 1.

As seen in FIGS. 3 and 4, the conductors 16 alternate between a longer intermediate portion and a shorter intermediate portion and also between the intermediate portion substantially extending in a lower plane and an upper plane. The longer conductors extend rearwardly in the lower plane from a bottom side of the flat blade contact while the shorter conductors extend rearwardly in the upper plane from a top side of the blade portions 18. The intermediate portions of the longer conductors include a conical impression 54 which helps hold the conductor tightly in the slot 24. The shorter conductors are additionally fixed in the conductor slots 24 by retaining nubs 56 formed in the top front region of the slots of the plug 10.

Figure 7:
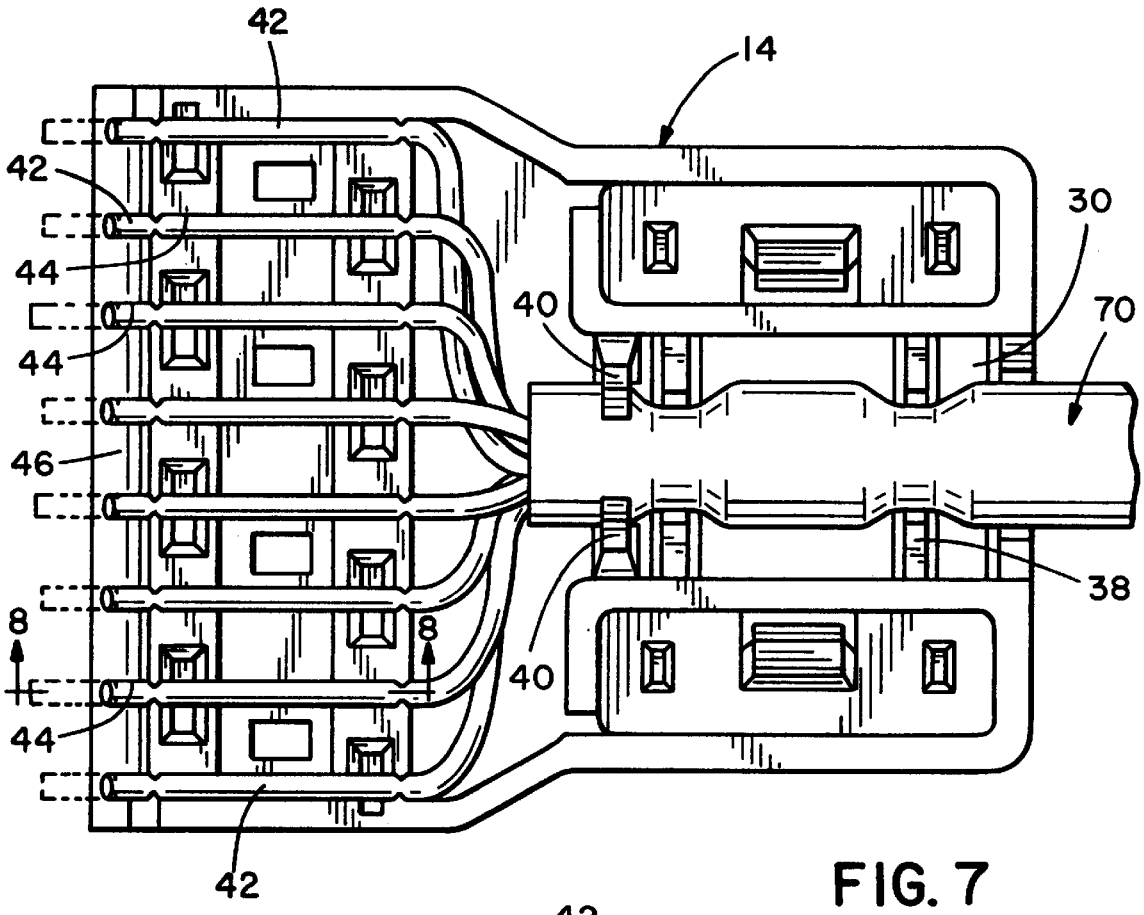
FIG. 7 is a plan view of the underside of the wiring housing of the patch cord connector of FIG. 1.
Figure 8:
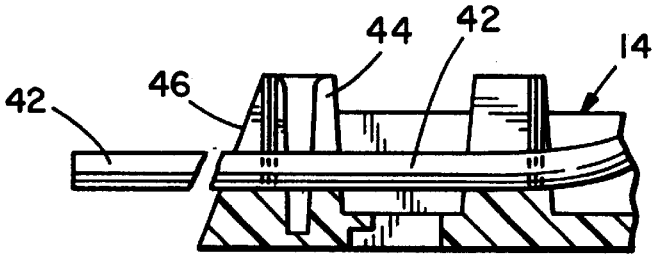
FIG. 8 is a sectional view of a portion of the wiring channel taken along line 8—8 of FIG. 7.
Figure 9:
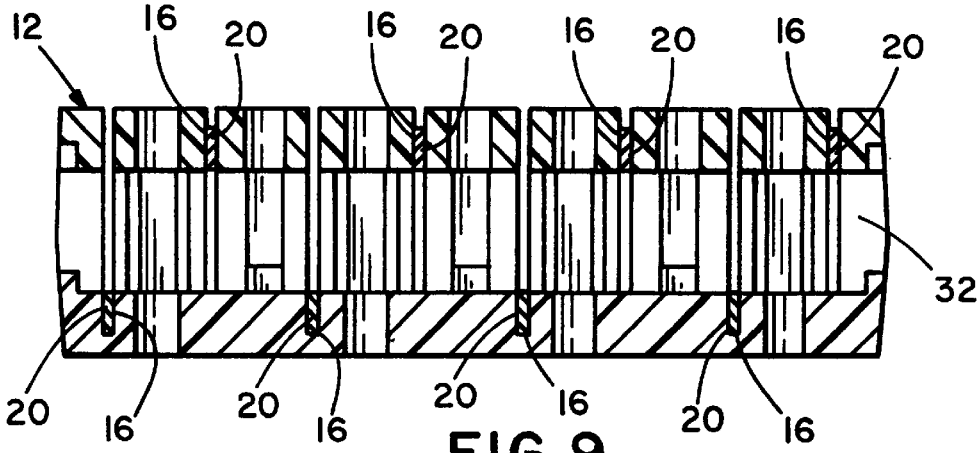
FIG. 9 is a sectional view taken along lines 9—9 of FIG. 4.
Figure 10:
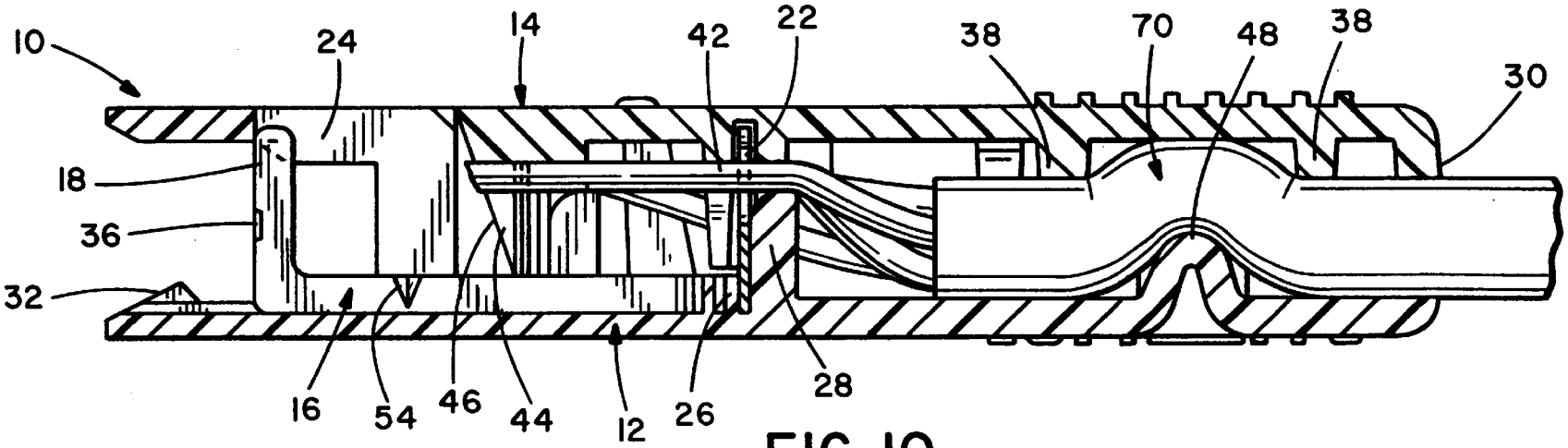
FIG. 10 is a sectional side view taken along lines 10—10 of FIG. 1.
Figure 11:
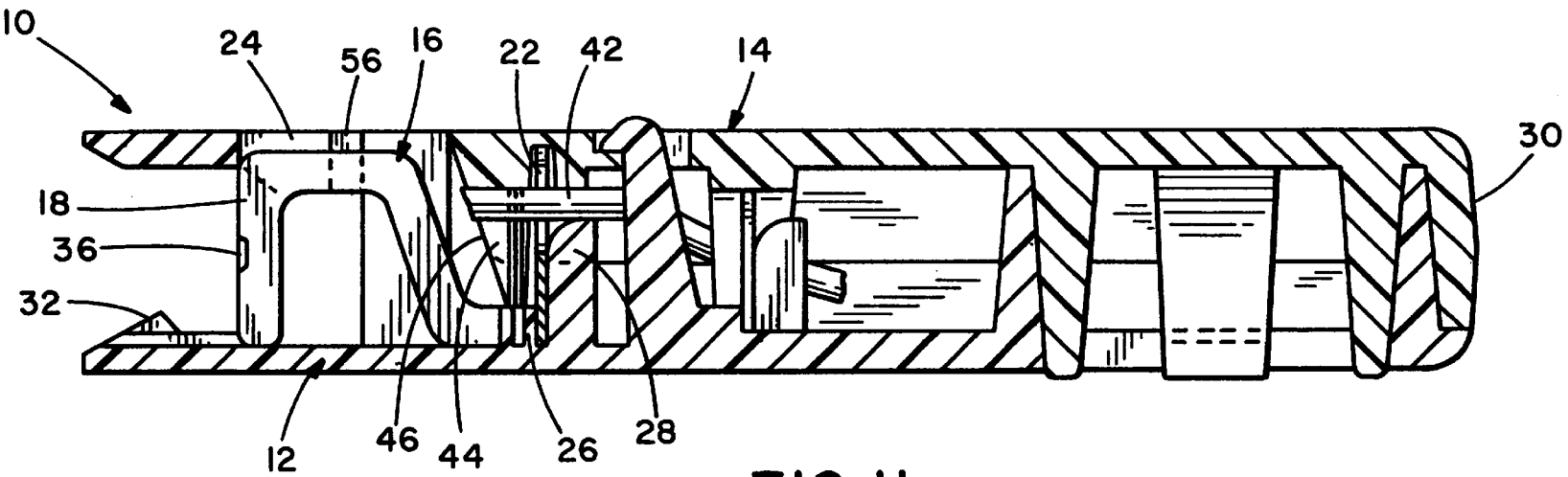
FIG. 11 is a sectional side view taken along lines 11—11 of FIG. 1.

As best seen in FIG. 7, the patch cord connector 10 is either factory or field terminated by first stripping the cable 70 end of its jacket and snapping the cable 70 into the securement ribs 38 and retaining clips 40 formed on the wire housing section 14. The individual wires 42 are then fed into their respective wire slots 44 which temporarily secure the wires 42. As can be seen in FIG. 8, the excess wire is then trimmed flush against the angled front 46 of the wire housing 12. This angled face 46 assures that if the wires 42 are trimmed slightly proud of the face 46, they do not interfere with the conductor housing 14 upon assembly. Once the wires 42 are trimmed, the conductor housing 14 is snapped together with the wire housing 12. This action causes the IDC portions 22 to pierce the wire insulation establishing continuity. The strain relief feature 48 pinches the cable, eliminating stress on wires 42 during connection and disconnection.

The patch cord connector 10 of the present invention utilizes a unique conductor configuration specifically designed to use the parallel runs and relative distances between conductor pairs to reduce the effect of cross-talk. Generally, cross-talk is increased when conductors run parallel to each other in close proximity. Additionally, the larger the surface area of the adjacent conductor portions, the greater the cross-talk which is heard by nearby conductor portions.

A standard patch cord connector contains a plurality of conductors comprising a plurality of pairs of adjacent conductors. Generally, one pair of conductors is used as a transmitting pair and a second pair of conductors is a receiving pair. Each of the conductors within the transmitting pair emits noise, while each conductors of the receiving pair hears the noise from each of the transmitting conductors. The cross-talk between pairs can be minimized by increasing the distance between the conductors, or by balancing the amount of noise heard by each of the receiving conductors from the transmitting conductors. When you have a balanced pair, the receiving conductors hear the same amount of noise from each of the transmitting conductors. This reduces the cross-talk between the pairs since the noise is cancelled out with the same amount being heard by both receiving conductors.

Figure 5:
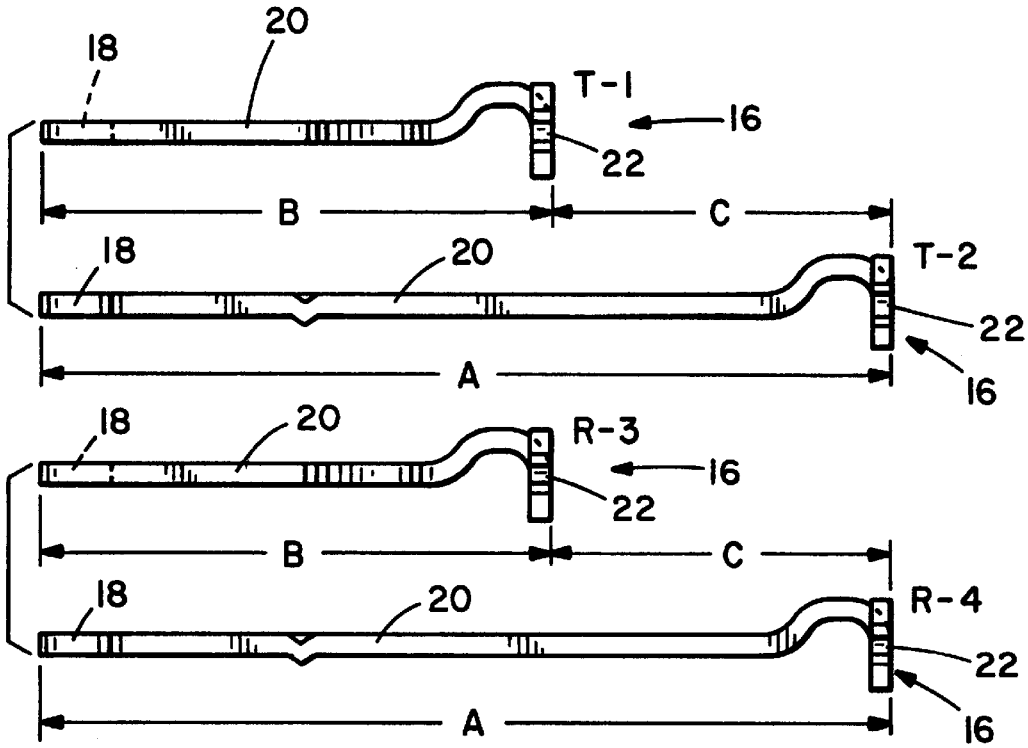
FIG. 5 is a plan view of the arrangement of two conductor pairs of the patch cord connector according to the present invention.
Figure 6:
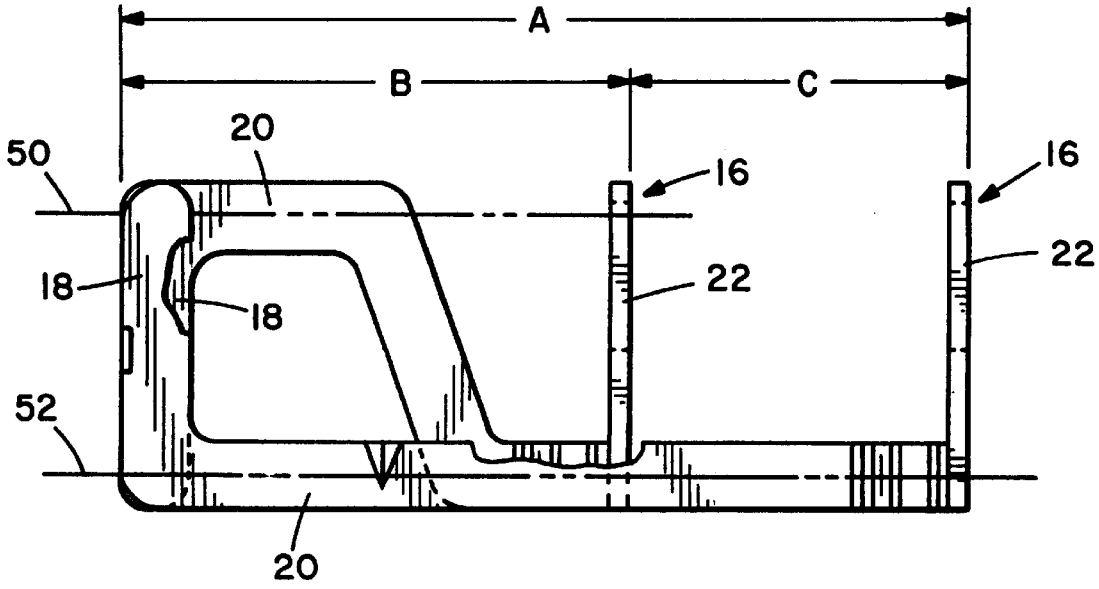
FIG. 6 is a side view of the conductors of FIG. 5.

As can best be seen with reference to FIGS. 5 and 6 which shows two pairs of conductors without the housing, the proposed conductor configuration has been specifically designed to reduce the effect of the cross-talk by balancing the cross-talk between the transmitting and the receiving pair. The transmitting pair of conductors is indicated by conductors T-1 and T-2 and the receiving pair of conductors are shown as conductors R-3 and R-4 in the drawings. As can be seen in FIG. 6, the intermediate portions 20 of adjacent conductors run substantially in two different planes with the shorter conductors extending rearwardly from a top end of the flat blade portion 18 so as to be primarily disposed in an upper plane and the longer conductors extending rearwardly from a bottom end of the flat blade portion 18 so as to be primarily disposed in a lower plane in order to reduce the overall noise between immediately adjacent pairs. This separation of adjacent conductors reduces the noise heard by adjacent conductors.

Therefore, making the alternating conductors longer results in a reduced cross-talk effect by balancing the noise heard by conductors R-3 and R-4 from conductor T-2. That is, the flat blade portion 18 of R-3 and the small intermediate portion near the IDC end of conductor R-3 is in closer proximity to the adjacent portions of conductor T-2 than the similar portions of R-4. Therefore without modifying receiving conductor R-4 the noise heard by R-3 from T-2 would be substantially higher than that of R-4 from T-2. However, the extra length of a parallel run between conductors T-2 and R-4 increases the noise between T-2 and R-4 to approximate the noise which is heard by conductor R-3 from conductor T-2. Therefore, by having the intermediate portions of adjacent transmitting and receiving conductors in spaced apart planes the total cross-talk effect of the immediately adjacent conductors T-2 and R-3 is minimized. Crosstalk is increased between T-2 and R-4 by having the intermediate portions 20 of the T-2 and R-4 run together for a longer parallel run to achieve balance.

The length of the shorter conductors in the preferred embodiment as indicated by "B" in FIG. 5 is 0.447 inches. Therefore, in order to properly balance the crosstalk, it has been learned through testing that the longer conductors should be 0.30 inches longer as indicated by "C" to have a length indicated by "A" of 0.747 inches.

This conductor arrangement to achieve cross-talk reduction by balancing the noise heard by the receiving conductors is effective regardless of which pair in the patch cord is the transmitting pair and which is the receiving pair.

Also, as can be seen in FIG. 3, located in the rear of the patch cord connector is a strain relief feature 48 and the cavities 60 which accepts the snaps 62 of the wire housing section 14. Front snaps 62 located between the conductors secure the front of the patch cord assembly together. It is important to note the snaps 62 are located on the conductor housing 12 and not on the wire housing 14 as in previous patch cord connectors. This positioning allows for rapid wire installation in the wire housing without any interference with the snaps. The rear snaps 64 including their guide posts 66 secure the rear of the plug assembly together by engaging with corresponding opening 68 on the conductor housing 12.

While the particular preferred embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical connector comprising:

a dielectric housing; and a plurality of conductors situated within the housing having a generally flat blade portion disposed at an output end of the housing, an intermediate portion and an insulation displacement contact (IDC) portion for receiving an individual wire, wherein the intermediate portions of adjacent conductors are alternately situated substantially in a lower or an upper plane and are alternately of a shorter or a longer length.

2. An electrical connector according to claim 1, wherein the IDC portions of adjacent conductors extend from the lower plane but are staggered into two rows.

3. An electrical connector according to claim 1, wherein the conductors of a longer length have the intermediate portion extend rearwardly from the blade portion in the lower plane.

4. An electrical connector according to claim 1, wherein the shorter conductors are approximately 0.447 inches in length and the longer conductors are approximately 0.747 inches in length.

5. An electrical connector according to claim 1, wherein the housing is a two-part housing with a conductor housing section and a mateable wire housing section having a plurality of wire holding slots and an angled front surface at a front end of the wire holding slots.

6. An electrical connector according to claim 1, wherein the housing is a two-part housing with a conductor housing section mateable with a wire housing section by front and rear snaps, wherein the front snaps are located on the conductor housing section so as to avoid interference with the wires during wire installation onto the wire housing section.

7. A patch cord plug connector for terminating a plurality of wires for electrically connecting to a plurality of insulation displacement conductors comprising:

a dielectric housing;

a plurality of laterally spaced apart conductors having an insulation displacement contact (IDC) portion at one end, a flat blade portion at a second end, and an intermediate portion extending therebetween;

wherein the intermediate portions of adjacent conductors are alternatingly long and short; and wherein the intermediate portions of adjacent conductors extend rearwardly from the blade portion in vertically spaced apart planes.

8. An electrical connector according to claim 7, wherein the IDC portions of adjacent conductors extend from a lower plane but are staggered into two rows.

9. An electrical connector according to claim 7, wherein the conductors of a longer length have the intermediate portion extend rearwardly from the blade portion in a lower plane.

10. An electrical connector according to claim 7, wherein the short conductors are approximately 0.447 inches in length and the long conductors are approximately 0.747 inches in length.

11. An electrical connector according to claim 7, wherein the housing is a two-part housing with a conductor housing section and a mateable wire housing section having a plurality of wire holding slots and an angled front surface at a front end of the wire holding slots.

12. An electrical connector according to claim 7, wherein the housing is a two-part housing with a conductor housing section mateable with a wire housing section by front and rear snaps, wherein the front snaps are located on the conductor housing section so as to avoid interference with the wires during wire installation onto the wire housing section.

13. A patch cord connector for terminating a plurality of wires for electrically connecting to a plurality of insulation displacement conductors, comprising:

a plurality of generally parallel laterally spaced apart conductors situated in adjacent conductor pairs within a dielectric housing, with at least one conductor pair being a transmitting pair and at least one conductor pair being a receiving pair, wherein the conductors of each conductor pair are of alternating lengths such that the noise received by each of the receiving conductors from the nearest transmitting conductor is substantially balanced.

14. A patch cord connector according to claim 13, wherein one conductor of each conductor pair is longer than the second conductor of that pair and an adjacent conductor from the adjacent pair.

15. A patch cord connector according to claim 13, wherein an intermediate portion of a longer conductor extends rearwardly from a bottom end of a front blade portion of the conductor and an intermediate portion of a shorter conductor extends rearwardly from a top end of a front blade portion of the conductor.

* * * * *